US008808422B2

(12) United States Patent
Kepplinger et al.

(10) Patent No.: US 8,808,422 B2
(45) Date of Patent: Aug. 19, 2014

(54) METHOD FOR INCREASING THE PENETRATION DEPTH OF AN OXYGEN STREAM

(75) Inventors: Leopold Werner Kepplinger, Leonding (AT); Robert Millner, Loosdorf (AT); Jan-Friedemann Plaul, Linz (AT); Johannes Leopold Schenk, Linz (AT); Kurt Wieder, Schwertberg (AT); Johann Wurm, Bad Zell (AT)

(73) Assignee: Siemens Vai Metals Technologies GmbH (AT)

( * ) Notice: Subject to any disclaimer, the term of this patent is extended or adjusted under 35 U.S.C. 154(b) by 0 days.

(21) Appl. No.: 13/818,344

(22) PCT Filed: Jul. 27, 2011

(86) PCT No.: PCT/EP2011/062880

§ 371 (c)(1), (2), (4) Date: Feb. 22, 2013

(87) PCT Pub. No.: WO2012/025321

PCT Pub. Date: Mar. 1, 2012

(65) Prior Publication Data

US 2013/0154166 A1 Jun. 20, 2013

(30) Foreign Application Priority Data

Aug. 25, 2010 (AT) ..... A 1422/2010

(51) Int. Cl.
*C21B 3/00* (2006.01)

(52) U.S. Cl.
USPC ..... 75/503; 75/375

(58) Field of Classification Search
CPC ..... C21B 5/00; C21B 5/001; C21B 5/003; C21B 5/006; C21B 13/006
USPC ..... 75/375, 503, 445, 448
See application file for complete search history.

(56) References Cited

U.S. PATENT DOCUMENTS 5,234,490 A 8/1993 Kundrat ..... 75/464
6,228,142 B1 * 5/2001 Shin et al. ..... 75/375

(Continued)

FOREIGN PATENT DOCUMENTS

CN 101573456 A 11/2009
DE 102005032444 A1 1/2007 ..... F27B 1/10

(Continued)

OTHER PUBLICATIONS

International Search Report, PCT/EP2011/062880, 3 pages, Oct. 19, 2011.

(Continued)

*Primary Examiner* — Scott Kastler
(74) *Attorney, Agent, or Firm* — Ostrolenk Faber LLP

(57) ABSTRACT

A method and device are disclosed for automatically evaluating a delivery system in respect of the energy efficiency and emissions efficiency thereof. The method may include: determining a service level for the delivery system according to an energy intensity and an evaluation relevance of the particular delivery system, detecting energy data and emissions data of the delivery system corresponding to the determined service level of the delivery system, and calculating at least one indicator based on the detected energy data and emissions data and/or based on data for the energy management and environmental management of the delivery system for evaluating the delivery system with respect to the energy efficiency and emissions efficiency thereof.

8 Claims, 3 Drawing Sheets

(56) References Cited

U.S. PATENT DOCUMENTS

| | | | | |
|---|---|---|---|---|
| 8,313,552 | B2 | 11/2012 | Kepplinger | 75/448 |
| 2013/0154166 | A1 | 6/2013 | Kepplinger et al. | 266/44 |

FOREIGN PATENT DOCUMENTS

| | | | | |
|---|---|---|---|---|
| DE | 102007027038 | A1 | 12/2008 | F27B 1/16 |
| EP | 0710726 | A1 | 5/1996 | C21B 11/02 |
| EP | 1 939 305 | A1 | 7/2008 | |
| EP | 1939305 | A1 | 7/2008 | C21B 5/00 |
| FR | 2070864 | A1 | 9/1971 | C21B 5/00 |
| WO | 98/28447 | A1 | 7/1998 | C21B 11/00 |
| WO | 00/05421 | A1 | 2/2000 | C10G 1/00 |
| WO | 2007/130362 | A2 | 11/2007 | B21D 39/00 |
| WO | 2009/062611 | A1 | 5/2009 | C21B 13/00 |
| WO | 2012/025321 | A2 | 3/2012 | C21B 13/00 |

OTHER PUBLICATIONS

Li et al., "Study on the rule of volume flow and numerical simulation of swirl nozzles used in wet FGD system," Electric Power, vol. 39, No. 8, pp. 68-71, Aug. 2006.

* cited by examiner

METHOD FOR INCREASING THE PENETRATION DEPTH OF AN OXYGEN STREAM

CROSS-REFERENCE TO RELATED APPLICATIONS

This application is a U.S. National Stage Application of International Application No. PCT/EP2011/062880 filed Jul. 27, 2011, which designates the United States of America, and claims priority to AT Patent Application No. A 1422/2010 filed Aug. 25, 2010. The contents of which are hereby incorporated by reference in their entirety.

TECHNICAL FIELD

The disclosure relates to a method for increasing the penetration depth of an oxygen stream of technically pure oxygen having a volume flow and a mass flow entering the bed of an iron ore production unit, for gasification of carbon carriers present in the bed.

BACKGROUND

In the production of pig iron in a pig iron production unit, such as furnace or a melt reduction unit for example, such as a melter gasifier used in the COREX® or FINEX® method, a reduction gas is obtained by gasification of carbon carriers by blowing in hot air or an oxygen stream. Oxidic iron carriers are reduced by means of this reduction gas and subsequently the reduced material obtained is melted into pig iron.

In the melter gasifiers used in the COREX® and FINEX® methods oxygen nozzles are built into the circumference of the melter gasifier between hearth and char bed of the melter gasifier, in order to blow in the oxygen for the gasification of carbon to produce the reduction gas and provide the energy necessary for smelting the iron carriers as evenly as possible at the circumference of the melter gasifier into the bed of the melter gasifier. When the iron carriers are smelted liquid pig iron and liquid slag are produced. The area of the melter gasifier below the oxygen nozzles, in which there is no throughflow by reduction gas, is referred to as the hearth in such cases. Located in the hearth are liquid pig iron, liquid slag and a part of the char. Thermally degased carbon carriers are referred to as char. The area of the melter gasifier lying above the oxygen nozzle is referred to in such cases as the char bed; as well as liquid pig iron and liquid slag and char, it also contains unmelted and partly reduced iron carriers and additives. Reduction gas which is formed by converting the introduced oxygen flows through the char bed. The oxygen streams entering the melter gasifier through the oxygen nozzles form what is known as the raceway within the melter gasifier, in which gasification of carbon carriers is already taking place, wherein reduction gas is already being produced. Raceway in such cases is to be understood as the eddy zone in front of the oxygen nozzles, in which the reduction gas is produced from oxygen and carbon carriers. The term eddy zone in this case reflects the highly turbulent eddy layer-like flow conditions in the area of the raceway. The incoming oxygen stream creates a cavern in the material of the char bed. The cavern is produced by the impulse of the arriving oxygen stream and by the gasification reaction of the oxygen with the char. The area of the cavern is referred to as the raceway. By comparison with the char bed, which represents a liquid bed, the raceway has a much higher number of gaps. The raceway extends in accordance with the arrangement of the oxygen nozzles on the circumference of the melter gasifier inside the melter gasifier in a horizontal plane. The cross-sectional surface which is formed when viewed from above by the length of the raceway, is also referred to as the active ring surface wherein, in the term active ring surface, the word active refers to the fact that drainage of liquid pig iron and liquid slag is carried out especially well by the raceway because of the number of gaps of the raceway, and the reduction as produced by gasification of carbon carriers enters from the raceway into the char bed. The width of the active ring surface is determined by the longitudinal extent of the raceway and thus by the penetration depth of the oxygen stream.

Even with a furnace in which hot blast or oxygen is blown in through nozzles, also called blast form raceways, distributed accordingly around the circumference of the furnace, raceways with active ring surface form in the area of the nozzles.

For the char bed of a melter gasifier, with the usual use of an oxygen stream of technically pure oxygen with a temperature of between −15° C. and +45° C. and because of the smaller diameter of the oxygen nozzles used by comparison with the packed bed present in a furnace operated with hot blast, a far lower penetration depth of the oxygen stream into the bed material is produced. Thus, through the shorter or respectively narrower raceway in the char bed, a comparatively small active ring surface at the circumference of the melter gasifier is produced by comparison with a furnace operated with hot blast, through which the gas permeability for reduction gas into the char bed or the drainage of liquid pig iron and liquid slag into the hearth respectively are comparatively worse. Furthermore, by comparison with furnaces operated with coke, by the use of lump coal and/or coal briquettes as carbon carriers, the hydraulic diameter of the char matrix in a melter gasifier is reduced, whereby the flowing away of liquid pig iron and/or liquid, specifically of highly viscous slag, is rendered more difficult, which can lead to problems from a buildup of liquid pig iron and/or liquid slag in front of the oxygen nozzles.

An increase in the penetration depth of the oxygen stream into the bed, both in a furnace operated with oxygen and also in a melter gasifier, would greatly increase the active surface and thus improve the drainage of liquid pig iron and of liquid slag.

The reduction gas essentially flows upwards. Viewed in the direction of flow of the reduction gas, after the raceway, i.e. above the raceway, undesired liquidized areas are produced in the bed of the melter gasifier or furnace, also called bubble or channel formation. Into these areas a quantity of gas at a high pressure enters the bed of solids and the mixture of solids and gas produced behaves like a liquid. The formation of liquidized areas is unwanted, because it can lead to blowing through the bed of the melter gasifier or of the furnace. Blow-throughs lead to suddenly increasing changes of the gas flow, dust loading and combination of the gas conveyed out of the melter gasifier or furnace, which makes it more difficult to manage the operation of such units. Furthermore with blow-through these particles are expelled from the melter gasifier or furnace into lines for drainage of reduction gas or blast furnace gas.

Liquidized areas are also unwanted since an optimum phase conduction of gas and solids is prevented by them. In liquidized areas the result can be a mixing of material from the upper and from the lower area of the char bed—thus for example iron oxide reaches into the lower area of the char bed from the upper area of the char bed and completely reduced and partly already melted iron from the lower area of the char bed will be transported into its upper area.

On introduction of a larger quantity of gas, specifically a larger quantity of oxygen into the bed, with melter gasifier and furnaces driven by oxygen, the danger of liquidized areas arising increases while the penetration depth remains the same.

If the penetration depth of the oxygen stream is increased in relation to a basic state, a specific quantity of gas can escape from the raceway into the bed via an increased surface compared to the basic state. Accordingly pressure conditions leading to formation of liquidized areas in the vicinity of the oxygen nozzles compared to the basic state will occur less often spatially and temporally, and as a result liquidized areas will be less large and occur less frequently in the vicinity of the oxygen nozzles.

In a melter gasifier, in the area of the entry of the oxygen stream into the bed, i.e. the raceway, because of the high speed of flow—which is higher by a multiple compared to a furnace, the chemical and thermal volume expansion, and because of the smaller char size by comparison with the average size of the coke in the furnace, an eddy zone occurs. In accordance with known conventions practically no increase of the penetration depth is achieved by a higher flow speed of the oxygen stream. An increase in the flow speed of the oxygen stream would increase the mechanical stress on the char. The mechanical stress would increase by impulse transmission between the particles of the oxygen stream and the components of the char bed—i.e. of the char—and consequently by impulse transmission between the components of the char bed themselves. Through the friction or decay of the char respectively caused by the impulse transmission, or by the mechanical stress resulting from said transmission, more fine grain would be formed in the eddy zone.

For the decay of the char the specific impulse transmitted per unit of space is the defining variable. The characteristic variable for this is the impulse force, which represents the specific impulse related to a unit of surface.

More fine grain in the eddy zone however leads to a reduction of the hydraulic diameter of the eddy zone of the raceway, which in its turn adversely affects the drainage of liquid pig iron and of liquid slag through the active ring surface.

In the case of a packed bed in a furnace, an increase in the penetration depth can be achieved by increasing the oxygen speed.

In this case a significant difference arises between a furnace operated with hot blast and a furnace operated with oxygen. The penetration depth of the oxygen stream is far less in a furnace operated with oxygen compared to the penetration depth of hot blast in a furnace operated by hot blast of the same power. The reason for this is because the mass flow of introduced gas is lower with an oxygen stream, since a large amount of nitrogen is not brought in with the required amount of oxygen as it is with hot blast. In the case of a furnace operated with oxygen, to achieve the penetration depth which is present in a furnace of the same output operated with hot blast, the oxygen speed would have to be increased by comparison with the speed of the hot blast—however this would result, as previously described, in increased mechanical destruction of the coke in the furnace as a result of impulse transmission and accordingly through fine grain formation to a lower gas permeability of the packed bed in the furnace.

SUMMARY

One embodiment provides a method for increasing the penetration depth of an oxygen stream of technically pure oxygen entering with a volume flow and a mass flow into the bed of an iron ore production unit, e.g., a smelter reduction unit/melter gasifier or an oxygen blast furnace, for gasification of carbon carriers present in the bed, wherein the ratio of volume flow to mass flow of the oxygen stream is increased.

In a further embodiment, the volume flow is increased while the mass flow remains the same.

In a further embodiment, the oxygen stream enters the bed at a flow speed, characterized in that the temperature of the oxygen stream is increased.

In a further embodiment, the temperature of the oxygen stream is increased while the flow speed remains the same.

In a further embodiment, the temperature of the oxygen stream is increased by means of one or by a combination of a number of the methods given below: Combustion of a solid, liquid or gaseous fuel with oxygen via a burner, and mixing of the hot gas obtained thereby with the oxygen, Mixing of oxygen with steam and/or hot nitrogen in a mixing chamber or at the blast input point, Use of indirect heat exchangers, and Preheating of oxygen by means of a plasma burner and mixing with oxygen not preheated in this way.

In a further embodiment, the oxygen stream enters the bed at an entry pressure, characterized in that the entry pressure is reduced while the mass flow remains the same.

In a further embodiment, the temperature of the oxygen stream entering the bed amounts to at least 200° C., e.g., at least 250° C.

In a further embodiment, the flow speed of the oxygen stream entering the bed lies in the range 100 m/s up to the speed of sound, e.g., in the range 150-300 m/s.

In a further embodiment, together with the oxygen stream, there is an injection of carbon carriers in solid or liquid or gaseous form, into the oxygen stream before the raceway formed in the area of the entry of the oxygen stream into the bed and/or in the raceway.

BRIEF DESCRIPTION OF THE DRAWINGS

Exemplary embodiments will be explained in more detail below based on the schematic drawings, wherein.

DETAILED DESCRIPTION

Figure 1:
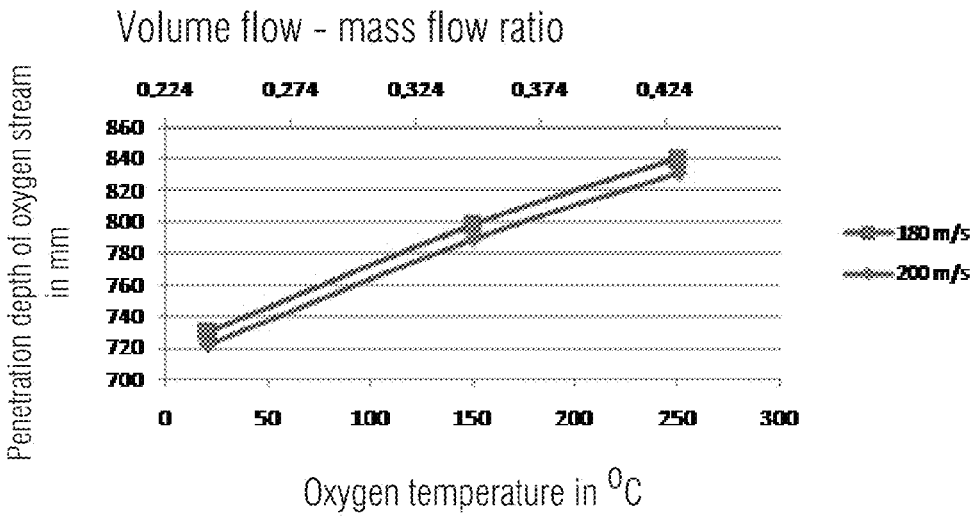
FIG. 1 shows an example relationship between oxygen stream penetration depth and a ratio of volume flow to mass flow of the oxygen stream, according to an example embodiment.

Embodiments of the present disclosure provide a method and device for introducing an oxygen stream into the bed of a pig iron production unit in which the disadvantages described above are avoided.

For example, some embodiments provide a method for increasing the penetration depth of an oxygen stream of technically pure oxygen entering into the bed of a pig iron production unit with a volume flow and a mass flow for gasification of carbon carriers present in the bed, wherein the ratio of volume flow to mass flow of the oxygen stream is increased.

Technically pure oxygen has an oxygen content of at least 85% by volume, e.g., at least 90% by volume.

The pig iron production unit may be a melter reduction unit such as a melter gasifier or an oxygen blast furnace for example.

The penetration depth may be increased by the ratio of volume flow to mass flow being increased.

Mass flow and volume flow relate to a given operating state; mass flow and volume flow at the pressure and temperature conditions obtained for a given operating state are thus meant.

By increasing the penetration depth of the oxygen stream into the bed the active ring surface of the melter gasifier is increased. Thus a lower flow speed of reduction gas is produced when this flows upwards through the char bed. Thus on the one hand a typical, but undesired bubble formation for eddy layers present in a melter gasifier is reduced and on the other hand the heat and material exchange between the reduction gas and the bed in the melter gasifier is improved.

The surface available for drainage of liquid pig iron and liquid slag is increased, with which a congestion of these liquids critical for the nozzles used for the introduction of the oxygen stream into the melter gasifier is reduced. In addition the increase of the penetration depth of the oxygen stream produces better metallurgical conditions in the hearth—for example better phase exchange between solid and liquid phases of slag and pig iron—and improved tapping off conditions compared to a lower penetration depth—fewer faults occur during the tapping-off process.

The volume flow may be increased while the mass flow remains the same. In this case a quantity of oxygen which remains the same is introduced into the bed per unit of time.

A mass flow which remains the same is to be understood here in the plant-technology sense and also includes the fluctuations determined in response to regulation to a given operating state—such as for example by a given melting power, heat requirement, type of raw materials used, pressure, temperature, – of up to +/−10% of the value which is desired for a given operating state.

The oxygen stream arrives in the bed with a flow speed. In accordance with one embodiment of the method the temperature of the oxygen stream is increased. Through the increase of the temperature the ratio of volume flow to mass flow is increased. Advantageously through the input of energy into the pig iron production unit connected therewith, savings can be made in other types of energy input, for example adding fuel to the pig iron production unit.

In accordance with a further embodiment of the method the temperature of the oxygen stream is increased while the flow speed is kept the same.

In this case keeping the flow speed the same is to be understood in the plant technology sense and also includes the fluctuations occurring in response to regulation to a given operating state of up to +/−10% of the value which is desired for a given operating state.

The measure of keeping the flow speed the same keeps the impulse of the oxygen stream resulting from the flow speed constant. With increased penetration depth and entry surface the impulse force is then reduced. This causes fewer fine grains to be formed.

In order to ensure a constant mass row at a temperature of the oxygen stream increased in relation to an initial value at a mass flow which remains the same, although the density of the oxygen stream reduces with an increase in the temperature, the diameter of the oxygen nozzles to be used at the higher temperature is designed correspondingly larger.

The oxygen nozzles may be insulated internally or the oxygen line to the oxygen nozzles may be insulated and/or be designed so that the heat losses are low.

To increase the temperature of the oxygen stream, it is preheated before its entry into the bed of the pig iron production unit.

This can be done by means of a single process or a combination of a number of the processes listed below:

- Combustion of a solid, liquid or gaseous fuel—for example process gases occurring from the process of pig iron production, in which the pig iron production unit is used, such as top gas from a reduction shaft: for example natural gas—with oxygen via a burner, and mixing of the hot gas obtained in this process with the oxygen.

The mixing in this case with the oxygen may take place in the combustion chamber of the burner in order to minimize the influence of the temperature on the outer walls of the lines conveying the oxygen.

- Mixing of oxygen with steam and/or hot nitrogen in a mixing chamber or at the blast point
- Use of indirect heat exchanges, for example
  - through preheating by using waste heat from COREX®/FINEX® process gases,
  - through preheating by steam,
  - through preheating by other heat carriers such as thermo oil or nitrogen,
  - through preheating via hot combustion gases from combustion fuels. This can for example also be done via hot combustion gases from existing systems such as for example systems for coal drying, reduction gas ovens, power stations.

For preheating by steam, condensation or back pressure heat exchangers can be used for example. The steam sources must in any event have a high availability.

Heated oxygen can be delivered directly from the oxygen production unit used for its provision. Thus warm oxygen occurring in an oxygen production system can be used and this can be done with or without additional heating. In accordance with one variant the oxygen in this case is heated in the oxygen production unit by indirect exchange of heat of the oxygen with hot process air of the oxygen production process.

In accordance with another variant the oxygen is heated up by adiabatic compression of gaseous oxygen.

The oxygen can also be heated up in 2 stages, by for example preheating to for example 100-150° C. first being undertaken at low oxygen pressure and subsequently an adiabatic compression to approximately 300° C. being carried out.

The oxygen can also be preheated in accordance with a further embodiment of the method by means of preheating of oxygen by means of the plasma burner and mixing it with oxygen not preheated in this way.

The oxygen may be preheated by waste heat of the oxygen production unit and/or by waste heat of a power station.

Primarily what is meant by an oxygen production unit here is an Air Separation Unit ASU. A plurality of compressors such as Main Air Compressor MAC, Booster Air Compressor (BAC) are present in such an ASU. In Combined Cycle Power Plants in particular gas turbines are present which are coupled to air compressors. Downstream of such compressors in air production units or power stations heated gas occurs through compression, the heat of which is vented into the environment as waste heat. This waste heat may be used for heating the oxygen which is introduced into the packed bed of the melter gasifier.

An increase of the temperature of the oxygen stream leads to a reduced requirement for carbon carriers for provision of the energy necessary for melting the iron carriers. This makes the process of pig iron production easier and specific emissions, especially of $CO_2$, are reduced in pig iron production.

The oxygen stream enters the bed under an entry pressure which is selected so that the pressure loss occurring during the flow of the reduction gas formed during the conversion of the oxygen over the char bed through to the plenum chamber can be overcome.

According to one embodiment of the method the entry pressure is reduced while the mass flow remains the same. To be able to let the process of pig iron production continue in this case the pressure in the agitation chamber is simultaneously lowered or the char bed is reduced in size to reduce the pressure loss. By reducing the entry pressure a higher volume flow can be achieved while the mass flow remains the same.

Mass flow remaining the same in this case is to be understood in plant technology terms and also includes the fluctuations occurring in response to regulation to a given operating state of up to +/−10% of the value which is desired for a given operating state.

In order to guarantee a mass flow that remains the same for an input pressure reduced in relation to an initial value, although the density of the oxygen stream decreases with a reduction in the pressure, the diameter of the oxygen nozzles to be used for the reduced pressure will be embodied correspondingly larger.

The temperature of the oxygen stream entering the bed may be at least 200° C., e.g., at least 250° C.

The flow speed of the oxygen stream entering the bed may be between 100 m/s and the speed of sound, e.g., in the range between 150-300 m/s. The speed of sound here means the speed under the pressure/temperature conditions of the oxygen on entry.

Below 100 m/s there is a great danger of nozzle damage through flow-back of liquid pig iron into the nozzles, beyond the speed of sound a high-pressure loss via the oxygen nozzles is produced and there is a high energy demand for establishing the pressure necessary for such a speed. In addition the large impulse associated with such high speeds greatly contributes to undesired formation of fine grains.

In accordance with one embodiment of the method, together with the oxygen stream there is an injection of carbon carriers in solid or liquid or gaseous form, for example coal/oil/own gas, into the oxygen stream before the raceway formed in the area of the entry of the oxygen stream into the bed and/or in the raceway.

The effect obtained here is that by gasification of these carbon carriers an effectively greater gas volume is formed in the raceway and introduced into the bed than if only the oxygen stream enters the bed—since the introduced gas volume is composed of the incoming oxygen stream and the gas arising during gasification—called the resulting gas stream. For the same amount of oxygen entering the bed an increase of the ratio of volume flow to mass flow of the resulting gas stream entering is thus achieved. The amounts injected and the purity of the oxygen stream into which the injection is made or into the raceway of which the injection is made are selected so that the resulting gas stream still involves technically pure oxygen.

Coal is supplied for example as coal dust. Oil is supplied as a fine mist for example. The own gas may be preheated to the temperature of the oxygen stream. Own gas is to be understood as reduction gas or export gas formed during the process of pig iron production to which the oxygen contributes.

The specifications mass flow, volume flow, temperature, pressure of the oxygen stream and also the values for mass flow, volume flow, temperature, pressure of the oxygen stream relate to the point at which the oxygen stream is fed into the bed.

FIG. 1 shows an example for how the penetration depth of the oxygen stream increases with an increase in the ratio of volume flow to mass flow of an oxygen stream. The mass flow is constant. FIG. 1 shows for example that with an increase of the ratio of volume flow to mass flow of around 90% from approximately 0.22 to approximately 0.42 $m^3$/kg, the penetration depth of the oxygen stream increases by approximately 15%. This relates to both of the flow speeds depicted.

Figure 2:
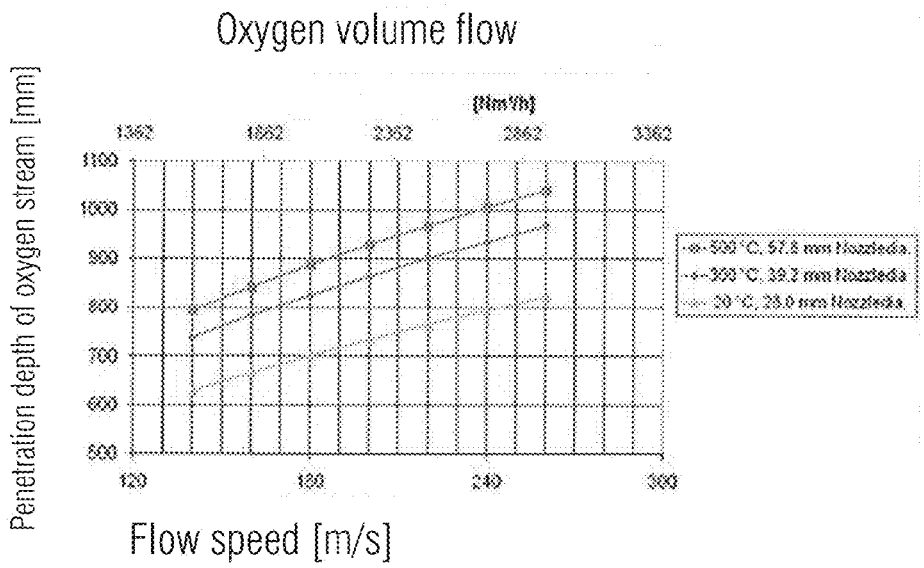
FIG. 2 shows an example relationship between oxygen stream penetration depth and oxygen volume flow, according to an example embodiment.

FIG. 2 also shows an example for how the penetration depth of an oxygen stream into the bed of a melter gasifier increases when the ratio of volume flow to mass flow of the oxygen stream is increased.

The mass flow of the oxygen stream remains the same. So that, with an increased temperature of the oxygen stream the flow speed remains the same, at higher temperatures larger diameters of the oxygen nozzles—abbreviated in the figure to Nozzledia—are used. It can be seen from FIG. 2 that with a consistent mass flow and a consistent flow speed, the penetration depth increases as the temperature rises. Since increasing temperature over decreasing density means greater volume, an increasing penetration depth is produced with an increase in the ratio of volume flow to mass flow of the oxygen stream.

Figure 3:
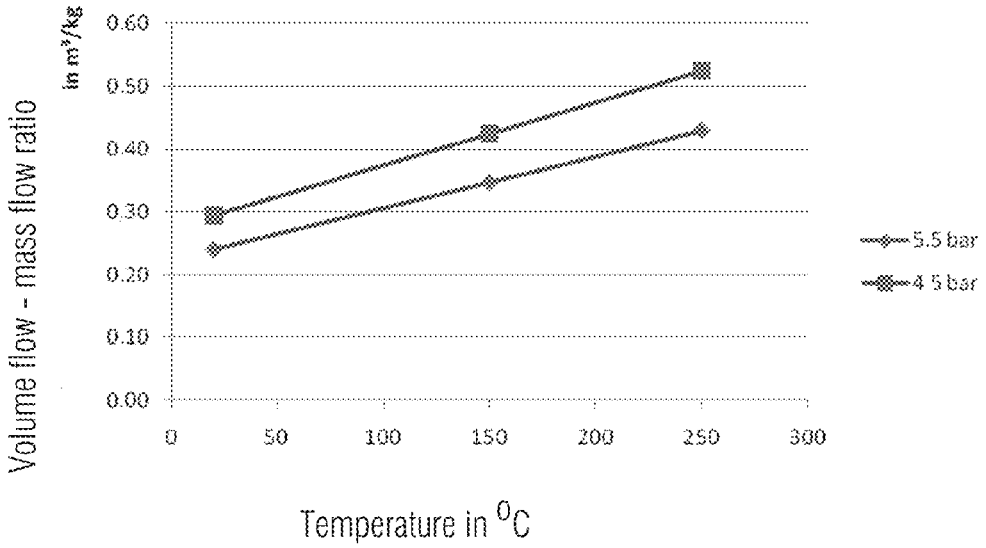
FIG. 3 shows an example relationship between ratio of volume flow to mass flow of the oxygen stream and entry pressure or temperature, according to an example embodiment.

FIG. 3 shows that the ratio of volume flow to mass flow of an oxygen stream increases with falling entry pressure or with rising temperature.

The basis for the figures presented was a mass flow of 2200 $Nm^3$/h of pure oxygen and an absolute pressure at the exit of the oxygen from the oxygen nozzles of 5.5 or 4.5 bar respectively.

Figure 4:
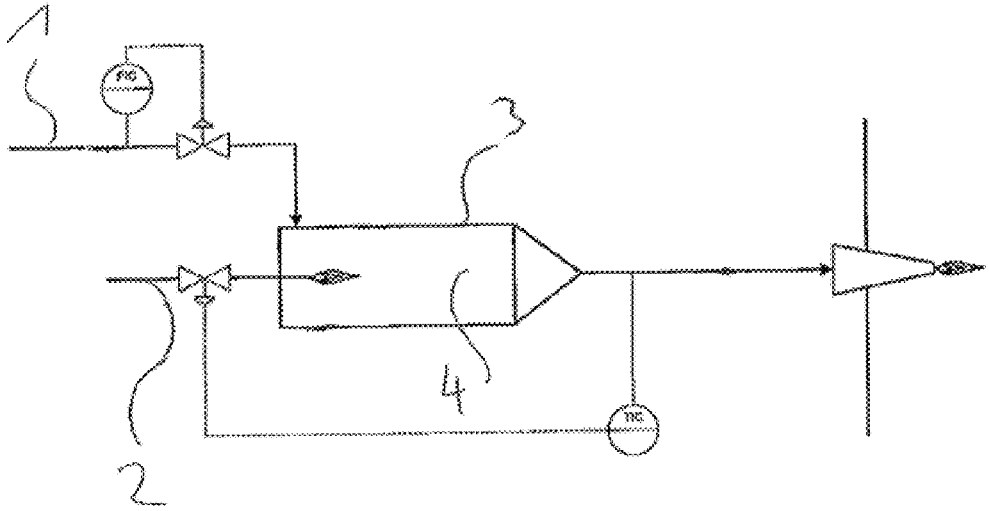
FIG. 4 is a schematic diagram of a first example arrangement for increasing the temperature of the oxygen stream while the flow speed remains the same.
Figure 5:
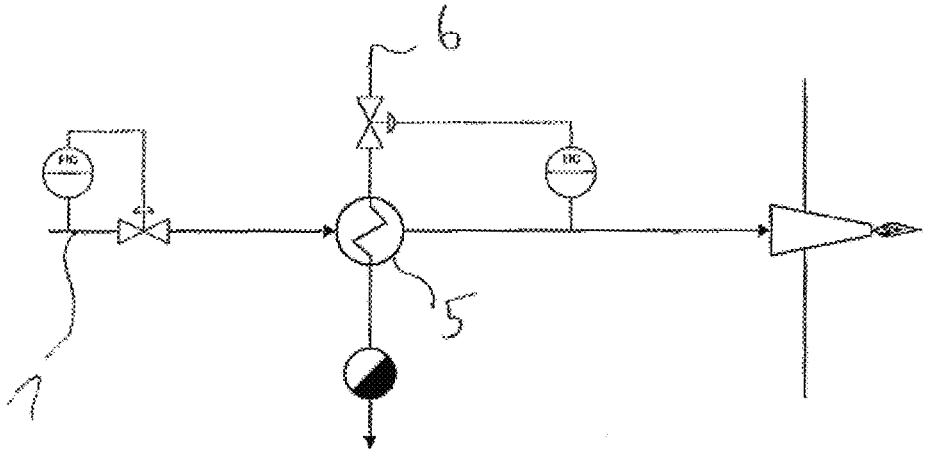
FIG. 5 is a schematic diagram of a second example arrangement for increasing the temperature of the oxygen stream while the flow speed remains the same.
Figure 6:
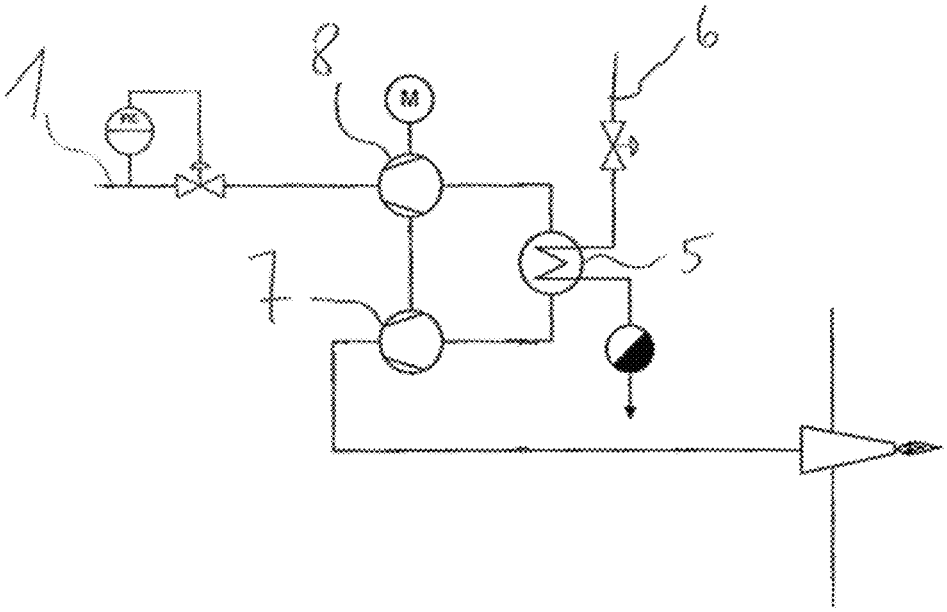
FIG. 6 is a schematic diagram of a third example arrangement for increasing the temperature of the oxygen stream while the flow speed remains the same.

FIGS. 4, 5 and 6 show schematic diagrams as examples of how the temperature of the oxygen stream can be increased while the flow speed remains the same. In these diagrams an oxygen nozzle is indicated schematically in each case at the right-hand edge of the diagram.

FIG. 4 shows schematically how oxygen 1 is heated by a gaseous fuel being used—in this case top gas 2 from a reduction shaft not shown in the diagram from the process for pig iron production in which the pig iron production unit is used—being burned with a part of the oxygen 1 in a burner 3, and hot gas obtained here in the combustion is mixed with the unburned oxygen 1. The mixing takes place in this case in the combustion chamber 4 of the burner 3 in order to minimize the temperature influence on the walling of the lines conveying the oxygen. The pressure of the oxygen stream remains the same in this case, only the temperature increases.

FIG. 5 shows schematically how oxygen 1 is heated by the use of indirect heat exchangers 5. In indirect heat exchanger 5 heat from steam 6 is transferred to the oxygen, wherein the pressure of the oxygen stream remains the same.

FIG. 6 shows schematically how a heating up of oxygen 1 is undertaken in two stages. First of all a preheating at low pressure of the oxygen stream is undertaken by means of an indirect heat exchanger 5 and steam 6 and then an adiabatic compression of the oxygen preheated in this way in a compressor 7 is undertaken. In this case, before the preheating, the oxygen stream is expanded by adiabatic expansion in an expansion device 8 from an initial pressure to an intermediate pressure, wherein the temperature of the oxygen stream reduces. After the subsequent preheating of the oxygen under intermediate pressure the oxygen is then brought during the adiabatic compression back up to the initial pressure and is heated to the desired temperature during this process.

What is claimed is:

1. A method for increasing a penetration depth of an oxygen stream of technically pure oxygen entering with a volume flow and a mass flow and with a flow speed through at least one oxygen nozzle into the bed of an iron ore production unit for gasification of carbon carriers present in the bed, the method comprising:

increasing the volume flow of the oxygen stream while the mass flow of the oxygen stream remains constant by increasing the diameter of the at least one oxygen nozzle, and increasing a temperature of the oxygen stream while the flow speed remains constant.

2. The method of claim 1, comprising increasing the temperature of the oxygen stream by at least one of the following techniques:

combustion of a sold, liquid or gaseous fuel with oxygen via a burner, and mixing of the hot gas obtained therein with the oxygen, mixing of oxygen with steam and/or hot nitrogen in a mixing chamber or at the blast input point, use of indirect heat exchangers, and preheating of oxygen by means of a plasma burner and mixing with oxygen not preheated in this way.

3. The method of claim 1, wherein the oxygen stream enters the bed at an entry pressure, and the method comprises reducing the entry pressure while the mass flow remains constant.

4. The method of claim 1, wherein the temperature of the oxygen stream entering the bed amounts to at least 200° C.

5. The method of claim 1, wherein the temperature of the oxygen stream entering the bed amounts to at least 250° C.

6. The method of claim 1, wherein the flow speed of the oxygen stream entering the bed lies in a range between 100 m/s and the speed of sound.

7. The method of claim 1, wherein the flow speed of the oxygen stream entering the bed lies in a range between 150 m/s and 300 m/s.

8. The method of claim 1, comprising injecting carbon carriers in solid or liquid or gaseous form into the oxygen stream before a raceway formed in an area of the entry of the oxygen stream into the bed and/or in the raceway.

* * * * *